US005725201A

United States Patent [19]

Parth

[11] Patent Number: 5,725,201

[45] Date of Patent: Mar. 10, 1998

[54] ADJUSTABLE WIDTH PANEL ASSEMBLY

[75] Inventor: Leopold Parth, Ft. Thomas, Ky.

[73] Assignee: North American Pipe Corporation, Houston, Tex.

[21] Appl. No.: 552,187

[22] Filed: Dec. 11, 1995

[51] Int. Cl.[6] ..... E04H 17/16

[52] U.S. Cl. ..... 256/24; 256/19; 256/73; 52/588.1; 160/235

[58] Field of Search ..... 256/24, 19, 59, 256/65–73, 56; 52/588.1, 592.4, 530; 160/229.1, 235

[56] References Cited

U.S. PATENT DOCUMENTS

| | | | |
|---|---|---|---|
| 671,444 | 4/1901 | Kinnear | 160/235 |
| 2,809,017 | 6/1957 | Wong . | |
| 2,877,600 | 3/1959 | Slate . | |
| 3,119,473 | 1/1964 | Mitchell, Jr. | 52/530 |
| 3,234,697 | 2/1966 | Toti et al. . | |
| 3,524,292 | 8/1970 | Bottom . | |
| 3,606,718 | 9/1971 | Curran | 52/588.1 X |
| 3,955,801 | 5/1976 | Soriero, Jr. | 256/65 |
| 4,188,019 | 2/1980 | Meredith | 256/73 X |
| 4,223,503 | 9/1980 | Hague . | |
| 4,266,385 | 5/1981 | Oehlert . | |
| 4,312,166 | 1/1982 | Mock . | |
| 4,819,398 | 4/1989 | Dameron . | |
| 4,918,898 | 4/1990 | McLeod, Jr. | 52/588.1 |
| 4,969,618 | 11/1990 | Kennedy et al. . | |
| 5,149,061 | 9/1992 | Borgnini . | |
| 5,255,897 | 10/1993 | Pepper | 256/59 |

FOREIGN PATENT DOCUMENTS

| | | | |
|---|---|---|---|
| 2015068 | 9/1979 | United Kingdom | 52/588.1 |
| 2139682 | 11/1984 | United Kingdom | 160/235 |

OTHER PUBLICATIONS

A single sheet of photographs is enclosed which illustrates a panel from a vinyl fence which, upon information and belief was invented and was being used prior to the present invention.

*Primary Examiner*—Harry C. Kim
*Attorney, Agent, or Firm*—Tobor & Goldstein, L.L.P.

[57] ABSTRACT

An adjustable-width panel assembly for the construction of fences, walls, and other structures incorporating panels, which minimizes the need for separate fasteners to interconnect successive panel members.

1 Claim, 3 Drawing Sheets

740
700
710
900
715
720
800
600

803
716
807
700
801
800
804
802
805

710
700
804
800
800
650
600
850
852
171
170
851
701
900
805
806

ADJUSTABLE WIDTH PANEL ASSEMBLY

BACKGROUND OF THE INVENTION

1. Field Of The Invention

The invention relates to an adjustable-width panel assembly having first and second panel members which include connecting means that provide lateral movement of the panels relative to one another, whereby the cumulative width of the panel members is laterally adjustable to provide an efficient and effective means of construction for fences, privacy walls, and similar structures incorporating panels.

2. Description Of The Prior Art

Fences and privacy walls constructed using numerous, inter-connected panels have been in use for many years. Typically, such structures utilize a plurality of panels fabricated from metals, alloys, and thermoplastic materials. A number of means for connecting the panels to one another have been utilized, including rivets, screws, nails, and similar fasteners.

Fences are typically constructed from wooden materials, with wooden fence posts, typically 4 inches by 4 inches square in cross-section. A stringer, typically also 4 inches in width, is provided between posts near the upper and lower portions of the fence posts, as by the use of connectors such as nails. Panel members, also typically of wooden construction, are nailed to the stringers on one either one side of the fence, the other side of the fence, or through various alternating patterns.

In typical fence construction using wooden materials, the panel members are mounted substantially coplanar with an outside surface of the fence post. This allows for continuous nailing of the wooden panel members to the stringer, even over the fence post, as the panel members are attached along numerous sections over the entire length of the fence. One advantage of such construction is that precise placement of the posts is not necessary. Because the panel members are connected to the face of the stringers (which is substantially coplanar with an outside surface of the fence post), exact spacing is immaterial to a successful installation or construction. However, wooden fences and other types of fences that require separate fasteners to fasten the panel members to the fence may have a number of disadvantages, as further described below.

Other types of fence construction may involve the use of assemblies of inter-connected panel members. However, it has been found that attachment of the final panel member of each post-to-post section may require special attention, such as by cutting and trimming excess material, when the fence post wasn't located properly on, for example, 8 foot centers.

Further, use of separate fasteners may add additional, undesirable expense to construction costs and may also contribute to failure of the integrity of the structure, due either to wear at the point of connection and/or misapplication of the fasteners by relatively unskilled workers. Additionally, use of such fasteners may not provide for expansion and/or contraction of the panel members due to changes in temperature or other factors. Moreover, use of such fasteners may be time consuming and increase the time for construction, also allowing a tendency for error, which may reduce the quality of construction.

Other means have been utilized for inter-connecting panel members that eliminate the need for separate fasteners, including elaborate flange members provided at opposite sides of the panels that matably fit with one another, as well as simple, arcuate portions which slidably engage one another to connect the panels. However, a number of such connection means may require that long panels be located lengthwise, end to end, taking care to maintain generally planar alignment between the members as the members are slidably moved to a side-by-side relation. Further, such means may not provide for expansion or provide for adjustability of the width of the panel assembly. Such slidable means may further increase the time and effort required for the construction, thereby increasing construction costs and fatigue of the workers.

Other connection means incorporating flange members may eliminate some of the problems associated with slidable engagement and allow for snapable or rotatable connection. However, such connection means may not provide adequate tolerances at the point of connection for expansion of the panel members, may require an undesirable degree of care in calculating the dimensions involved and in the placement of certain supporting structures that may be used in the construction of the fences, privacy walls, and similar structures. Such panel connection means may further require additional labor such as for cutting or trimming of a portion of the panel member to be connected to the supporting member where relatively close tolerances were not observed or where precise calculations were not done, and/or when supporting structures, such as fence posts, were not carefully located.

Accordingly, prior to the development of the present invention, there has been no adjustable-width panel assembly which: is simple and economical to manufacture; is easily and quickly utilized; is effective to inter-connect successive panel members without separate fasteners; and provides lateral adjustability of a structure comprised of inter-connected panel members. Therefore, the art has sought an adjustable-width panel assembly which: is simple and economical to manufacture; is easily and quickly utilized; is effective to inter-connect successive panel members without separate fasteners; and provides lateral adjustability of a structure comprised of inter-connected panel members.

SUMMARY OF THE INVENTION

A feature of the present invention is that, when successive panel members are inter-connected to span a distance such as a horizontal distance between posts, the cumulative lateral movement of all panel members may provide a degree of lateral movement over a portion of the spanned distance sufficient to close a gap which may be present between the final panel and its supporting post, thus decreasing the close tolerances required and the need for the precise calculations and care generally associated with placement of supporting posts.

In accordance with the invention, some of the foregoing advantages have been achieved through the present adjustable-width panel assembly. The panel assembly of the present invention may include: at least one first panel member, having a desired length, a connecting portion, first and second side portions, top and bottom edges, and inner and outer surfaces; at least one second panel member, having a desired length, a connecting portion, first and second side portions, top and bottom edges, and inner and outer surfaces; and laterally adjustable connection means for connecting the connecting portion of the first panel member to the connecting portion of the second panel member whereby the first and second panel members are laterally movable relative to one another such that the width of the panel assembly is adjustable upon lateral movement of at least one panel member.

The present invention may further include a first matable means disposed proximate the connecting portion of the first panel member, and a second matable means disposed proximate the connecting portion of the second panel member. Further, the first matable means may be either slidably or snapedly engageable with the second matable means. Another feature of the present invention is that the first matable means of the panel assembly may include a generally hook-shaped member disposed at least partially along the length of the first panel member; the second matable means may include a generally box-shaped member disposed at least partially along the length of the second panel member; and at least a portion of the box-shaped member may be engageable with at least a portion of the hook-shaped member.

An additional feature of the present invention is that the hook-shaped member of the first panel member may include a body portion extending from the inner surface of the first panel member generally transverse to the first panel member, the body portion having a length; the hook-shaped member may further include an arm portion extending generally angularly from the body portion generally in the direction away from the first side portion of the first panel member and generally in the direction of the inner surface of the first panel member; and a channel may be disposed between the body and the arm portions of the hook-shaped member; the box-shaped member of the second panel member may include a first body portion extending from the inner surface of the second panel member generally transverse to the second panel member, a second body portion disposed proximate the first body portion of the box-shaped member and extending generally in the direction away from the second side portion of the first panel member, a leg portion disposed proximate the second body portion of the box-shaped member, the leg portion extending generally in the direction of the inner surface of the second panel member and having a length, and an arm portion disposed proximate the leg portion and extending generally angularly in the general direction of the first body portion of the box-shaped member, whereby the leg and arm portions of the box-shaped member of the second panel member may be insertable into the channel of the hook-shaped member of the first panel member.

A further feature of the present invention is that the length of the body portion of the hook-shaped member may be greater than the length of the leg portion of the box-shaped member, whereby at least a portion of the box-shaped member is loosely engageable with at least a portion of the hook-shaped member to loosely interconnect the first and second panel members such that each of the inter-connected panel members is laterally moveable relative one another. The hook-shaped member may include an arm portion, the box-shaped member may include a leg portion and a first body portion, and the arm portion of the hook-shaped member may extend between the leg portion of the box-shaped member and the first body portion of the box-shaped member, thereby looseably connecting the first panel member to the second panel member, allowing lateral movement of the first panel member relative the second panel member, and generally preventing substantial transverse and rotatable movement of the first panel member relative the second panel member.

In accordance with another aspect of the present invention, some of the foregoing advantages have also been achieved through a fence of the present invention. The fence may comprise: at least one first fence post; at least one second fence post, spaced apart from the at least one first fence post to provide a post distance between the at least one first fence post and the at least one second fence post; at least one stringer; and an adjustable width panel assembly having a width, comprising at least one first panel member, comprising a connecting portion, at least one second panel member comprising a connecting portion, and laterally adjustable connection means for connecting the connecting portion of the first panel member to the connecting portion of the second panel member, whereby the first and second panel members are laterally movable relative to one another such that the width of the panel assembly is adjustable upon lateral movement of at least one panel member, the adjustable width panel assembly being attached to the at least one first fence post, the at least one second fence post, and the at least one stringer, whereby the adjustable width panel assembly spans the post distance between the at least one first fence post and the at least one second fence post.

A feature of the present invention is that the at least one first panel member may further comprise a length, first and second side portions, top and bottom edges, and inner and outer surfaces; the at least one second panel member may further comprise a length, first and second side portions, top and bottom edges, and inner and outer surfaces; and the at least one second panel member may further comprise a length, first and second side portions, top and bottom edges, and inner and outer surfaces. Another feature of the present invention is that the adjustable connection means may include: a first matable means disposed proximate the connecting portion of the first panel member and a second matable means disposed proximate the connecting portion of the second panel member; the first matable means may be either slidably or snapedly engageable with the second matable means, and may include a generally hook-shaped member disposed at least partially along the length of the first panel member; the second matable means may include a generally box-shaped member disposed at least partially along the length of the second panel member; and at least a portion of the box-shaped member may be engageable with at least a portion of the hook-shaped member.

The hook-shaped member of the first panel member may include a body portion extending from the inner surface of the first panel member generally transverse to the first panel member, the body portion having a length, and the hook-shaped member may further include an arm portion extending generally angularly from the body portion generally in the direction away from the first side portion of the first panel member and generally in the direction of the inner surface of the first panel member, and a channel may be disposed between the body and the arm portions of the hook-shaped member. Further, the box-shaped member of the second panel member may include a first body portion extending from the inner surface of the second panel member generally transverse to the second panel member, a second body portion disposed proximate the first body portion of the box-shaped member and extending generally in the direction away from the second side portion of the first panel member, a leg portion disposed proximate the second body portion of the box-shaped member, the leg portion extending generally in the direction of the inner surface of the second panel member and having a length, and an arm portion disposed proximate the leg portion and extending generally angularly in the general direction of the first body portion of the box-shaped member, wherein the leg and arm portions of the box-shaped member of the second panel member are insertable into the channel of the hook-shaped member of the first panel member.

The present invention may further be directed to a method of constructing a fence, comprising the steps of: providing a foundation; providing at least one first fence post proximate the foundation; providing at least one second fence post proximate the foundation and spaced-apart a post-to-post distance from the at least one first fence post; providing at least one first stringer having a length, two ends, a stringer connecting means for connecting the stringer to the at least one first and second fence posts, and a slot along its length; disposing the at least one stringer between the at least one first and second fence posts; connecting the at least one stringer to the at least one first and second fence posts; providing an adjustable-width panel assembly, having a bottom edge, disposed between the at least one first and second fence posts, the panel assembly further having a bottom edge disposed within the stringer slot; expanding the panel assembly to span the post-to-post distance; and connecting the panel assembly to the at least one first and second fence posts.

The method may further include the steps of: providing a snapable projection proximate at least one end of the at least one first stringer; providing an aperture in the fence post adapted to receive at least one end of the stringer; inserting at least one end of the stringer into the aperture provided in the fence post; and applying a compressive force to the stringer and the fence post to snapedly engage the at least one end of the at least one first stringer within the fence post.

The adjustable-width panel assembly of the present invention, when compared with previously proposed panel assemblies, has the advantages of being simple and economical to manufacture, being easily and quickly utilized, being effective to interconnect successive panel members without separate fasteners, and providing lateral adjustability of the resulting structure.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF SPECIFIC EMBODIMENTS

Figure 1:
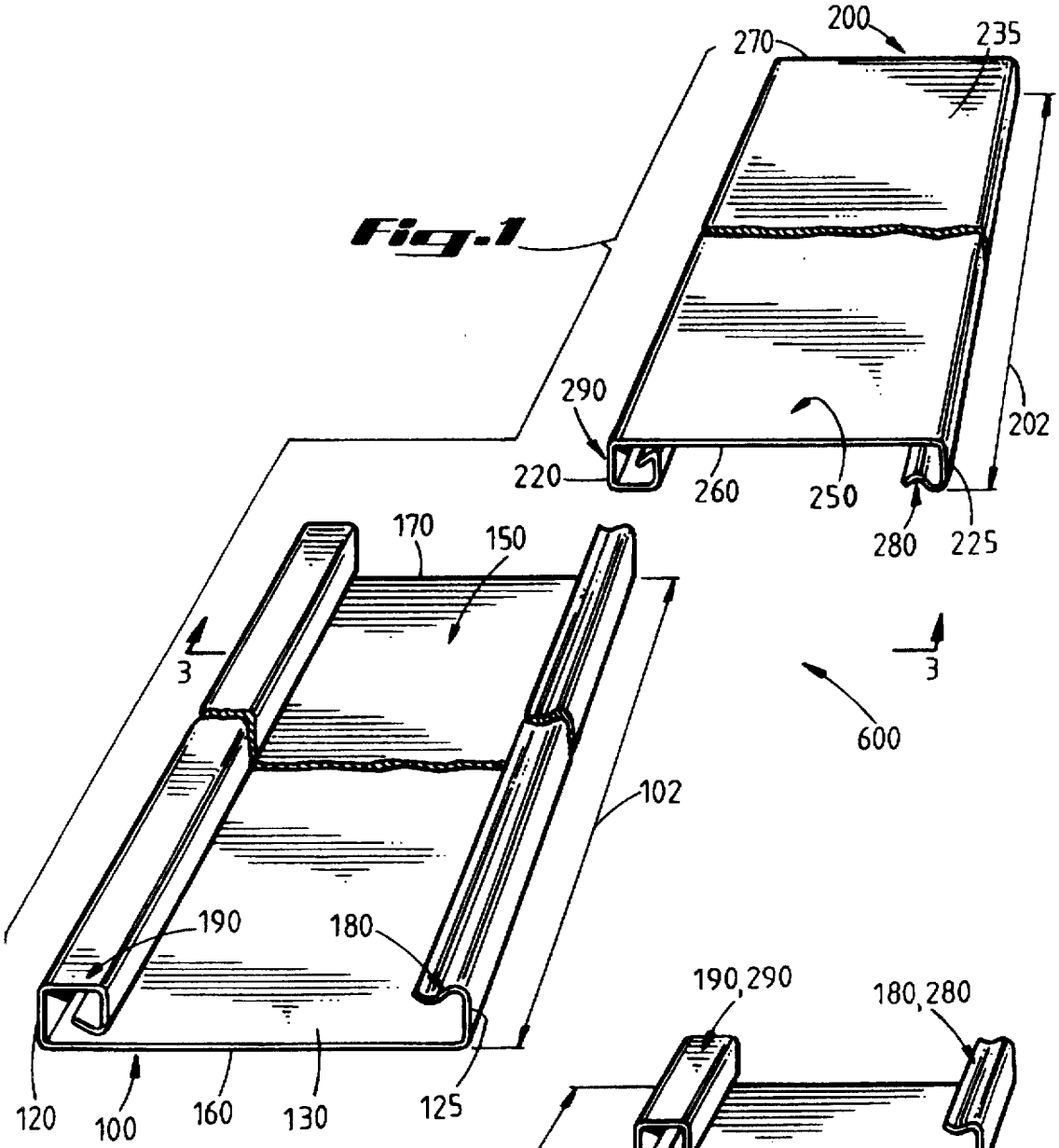
FIG. 1 is a perspective view of two successive panel members, in accordance with the present invention, having matable means extending along their entire lengths.
Figure 2:
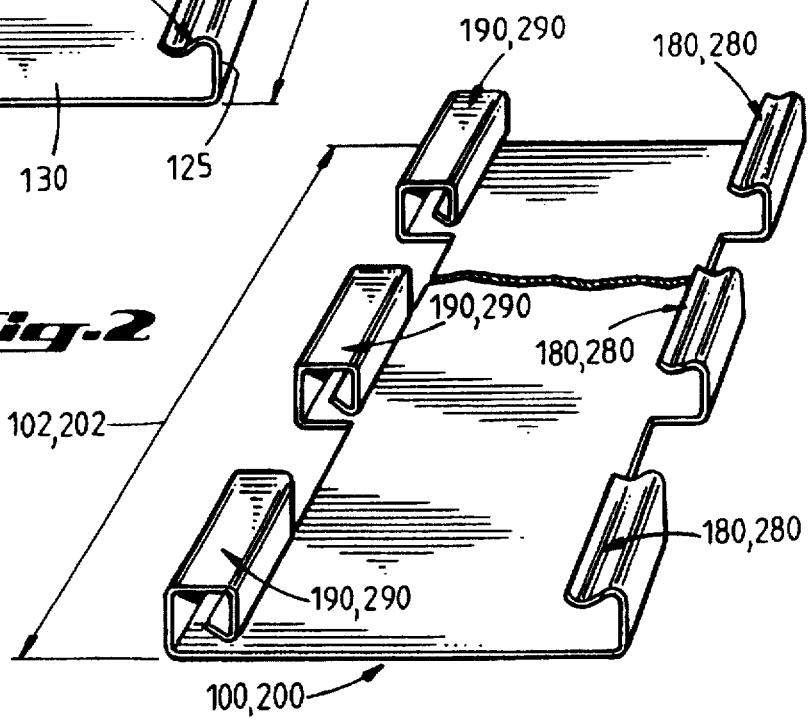
FIG. 2 is a perspective view of a panel member, in accordance with the present invention, having a plurality of matable means spaced-apart along its length.
Figure 3:
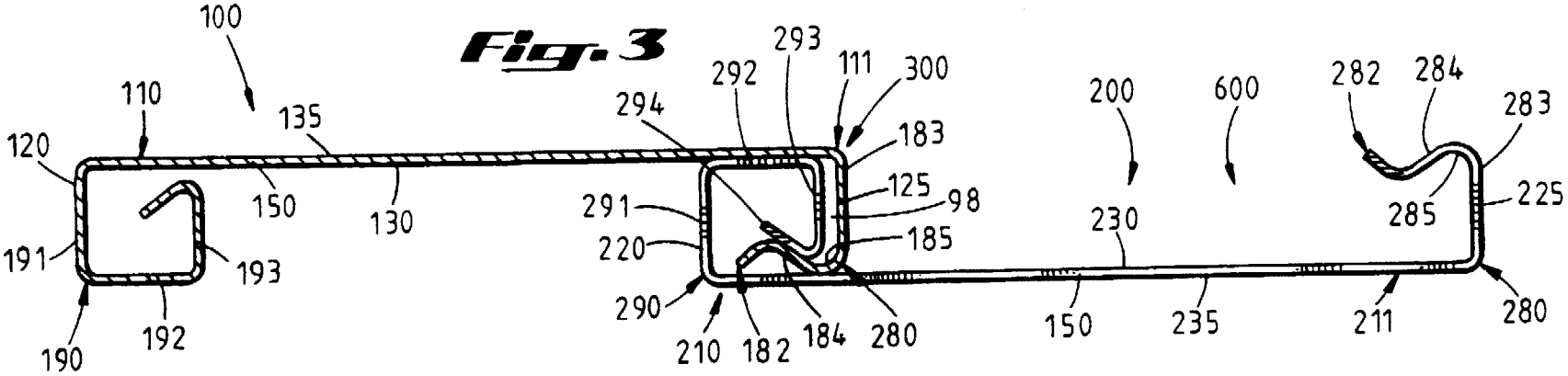
FIG. 3 is a cross-sectional view of a panel assembly of the two successive, inter-connected panel members of FIG. 1, taken along line 3—3 of FIG. 1, in accordance with the present invention, and showing an open gap for lateral expandability of the assembly.
Figure 4:
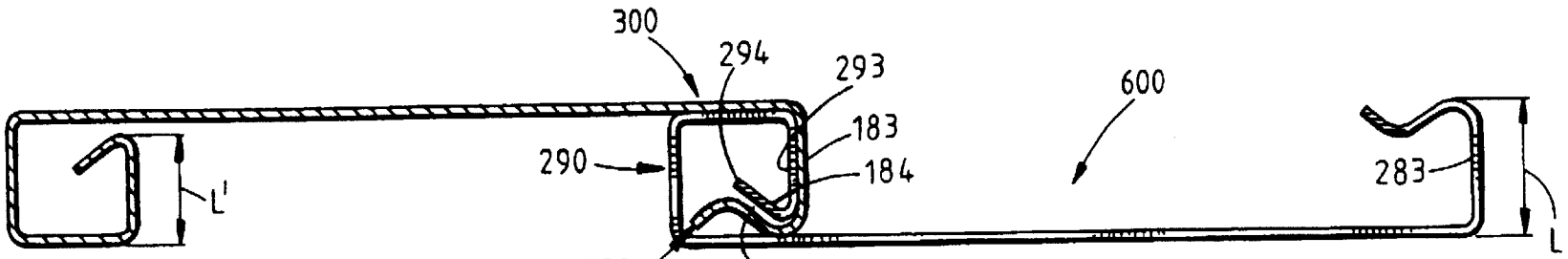
FIG. 4 is a cross-sectional view similar to FIG. 3 of a panel assembly of two successive, inter-connected panel members, in accordance with the present invention, wherein the gap shown in FIG. 3 has been closed to increase the width of the assembly.

In FIGS. 1–5, a panel assembly 600, in accordance with the present invention is shown comprising at least two panel members 100, 200. In the preferred embodiment, the panel members are preferably extruded from polyvinyl chloride (PVC); however, the panel members may also be manufactured using any suitable thermoplastic material, such as polypropylene, polyethylene, low density polyethylene (LDPE), vinyl acetate copolymers, vinyl chloride monomers (VCM), or acrylonitrile-butadiene-styrene (ABS), which may have the requisite durability, strength, and flexibility characteristics which may be necessary for the invention as hereinafter described. Furthermore, panel members may also be manufactured using other materials and/or processes. For example, the panel members may be molded from a suitable thermoplastic material or may be extruded, or formed, by a die from metals or metallic alloys. The use of the term "panel assembly"throughout the specification and the claims is intended to relate to any number of panel members, which may be inter-connected and installed between fence posts or other supporting structures. Referring to FIGS. 3 and 4, it will be apparent that each panel member of the present panel assembly may be identical in structure, so that a detailed description of one may suffice for the others. Further, other supporting structures may be used; for example, a group of panel assemblies may be connected in a continuous ring-shaped arrangement and fastened to a ring-shaped supporting member for use as, for example, a composting or containing structure.

With reference to FIGS. 1–4, the adjustable-width panel assembly 600 of the present invention generally comprises: at least one first panel member 100, having a desired length shown by arrows 102, connecting portions, or connecting means, 110, 111, first and second side portions 125, 120, respectively, and inner and outer wall surfaces 130, 135, respectively; at least one second panel member 200, having a desired length shown by arrows 202, connecting portions 210, 211 first and second side portions 225 and 220, respectively, and inner and outer surfaces 230 and 235, respectively; laterally adjustable connection means 300 for connecting the first panel member 100 to the second panel member 200 and disposed proximate the connecting portion 110, 111 of the first panel member 100 and the connecting portions 210, 211 of the second panel member 200, whereby the first and second panel members 100, 200, are laterally movable relative one another such that the width of the panel assembly 600 is adjustable upon lateral movement of at least one interconnected panel member 100, 200.

With respect to FIGS. 1 and 2, in a preferred embodiment, each panel member 100, 200 may be of identical construction and be constructed of thermoplastic material and may have a desired length 102, 202 providing a generally elongate body 150, 250. The body 150, 250 may be substantially planar. Further, the panel member 100, 200 may include a first side portion 125,225 and a second side portion 120, 220 (which are defined as the lengthwise portions of the panel members 100, 200) disposed proximate connecting portions 110, 111 and 210, 211 (shown in FIGS. 3 and 4). Additionally, the body 150, 250 includes a top edge 160, 260 and a bottom edge 170, 270. The preferred embodiment includes top and bottom edges 160, 260 and 170, 270 respectively, lacking connecting portions.

Referring now to FIG. 3, the panel member 100, 200 includes first connecting portion 111, 211 and second connecting portion 110, 210 provided proximate first side portion 125, 225 and second side portion 120, 220, respectively. The preferred embodiment includes connecting portions 110, 210 and 111, 211 formed integrally with the body 150, 250, and forming the first side portion 125, 225 and the second side portion 120, 220. However, the connecting portions 110, 210 and 111, 211 may also be attached to either inner surface 130, 230 or outer surface 135,235, as by the use of adhesives or other attachment means. Further, connecting portions 110, 210 and 111, 211 may preferably form first side portion 125, 225 and second side portion 120, 220, respectively, or an extension portion (not shown) may extend beyond the connecting portions 110, 210 and 111, 211, where the connecting portions 110, 210 and 111, 211 are attached to the inner surface 130, 230 or the outer surface 135, 235 at a location inward of the side portions 125, 225, 120, 220.

Again, with reference to FIGS. 1–4, panel member 100, 200 may comprise a first matable means 180, 280 adapted to be disposed proximate the first connecting portion 111, 211 and a second matable means 190, 290 adapted to be disposed proximate the second connecting portion 110, 210. The first matable means 180, 280 includes a generally hook-shaped member 182, 282 disposed at least partially along the length of the panel member 100, 200. In the preferred embodiment, the matable means 180, 280 extends substantially along the entire length of the panel member 100, 200. However, as shown in FIG. 2, the matable means 180, 280 and 190, 290 may also extend only partway along a portion of the length 102, 202 of panel member 100, 200, and may further comprise a plurality of matable means 180, 280 and 190, 290 spaced-apart along the length of panel member 100, 200.

The hook-shaped member 182, 282 of the preferred embodiment includes a body portion 183, 283, having a length L. The body portion 183,283 extends from inner surface 130, 230 of the panel member 100, 200 generally transverse and preferably substantially perpendicular to the panel member 100, 200. The hook-shaped member 182, 282 further includes an arm portion 184, 284, which extends generally angularly from the body portion 183, 283 generally in the direction away from the first side portion 125, 225 of the panel member 100, 200 and generally in the direction of the inner surface 130, 230 of the panel member 100, 200. The hook-shaped member 182, 282 further includes a channel 185,285 disposed between the body portion 183, 283 and the arm portion 184, 284.

The second matable means 190, 290 includes a generally box-shaped member 190, 290 disposed at least partially along the length of the panel member 100, 200. However, as shown in FIG. 2, the matable means 190, 290 may also extend only partway along a portion of the length of panel member 100, 200 and may further comprise a plurality of matable means 190, 290 spaced-apart along the length of panel member 100, 200.

The box-shaped member 190, 290 of the preferred embodiment includes a first body portion 191, 291 extending from the inner surface 130, 230 of the panel member 100, 200 generally transverse to the panel member 100, 200. The box-shaped member 190, 290 further includes a second body portion 192, 292 disposed in communication with the first body portion 191, 291 and extending generally in the direction away from the second side portion 120, 220 of the panel member 100, 200. The box-shaped member 190, 290 further includes a leg portion 193,293 disposed in communication with the second body portion 192, 292 of the box-shaped member 190, 290. The leg portion 193,293 has a length L and extends generally in the direction of the inner surface 130, 230 of the panel member 100, 200. The box-shaped member 190, 290 further includes an arm portion 194, 294 disposed in communication with the leg portion 193, 293 and extending generally angularly in the general direction of the first body portion 192, 292.

Referring still to FIGS. 3 and 4, the interconnection of the first panel member 100 and a second panel member 200 will be hereinafter described. First, a first panel member 100 is provided, having a connecting means 111 comprised of a hook-shaped member 182. Then, a second panel member 200, having a connecting means 110 comprising a box-shaped member 290, is located in side-by-side relation to the first panel member 100 with its box-shaped member 290 overlying the hook-shaped member 182 of the first panel member 100, such that the inner surface 230 of the second panel member 200 opposes the inner surface 130 of the first panel member 100. At least a portion of the box-shaped member 290 of the second panel member 200 is snapedly engageable with at least a portion of the hook-shaped member 182 of the first panel member 100. The hook-shaped member 182 of the first panel member 100 defines a first matable means 180 while the box-shaped member 290 of the second panel member 200 defines a second matable means 290, wherein the first matable means 180 is snapedly engageable with the second matable means 290. Opposing forces are applied to the first panel member 100 and the second panel member 200, whereby at least a portion of the second matable means 290 is loosely and snapedly engaged with at least a portion of the first matable means 180 to loosely interconnect the first panel member 100 and the second panel member 200 such that each of the interconnected panel members 100, 200 is laterally movable relative one another.

Materials may be selected to provide sufficient rigidity and flexibility to allow the second matable means 290 to be loosely and snapedly engaged with the first matable means 180. It may be found that some materials provide certain desired characteristics such as rigidity for support of the resulting structure while providing insufficient flexibility to yield for snapping the matable memos 290 with the matable means 180. In practice, as opposing forces are applied to the first panel member 100 and the second panel member 200, the hook-shaped member 182 of the first panel member 100 and the box-shaped member 290 of the second panel member 200 may yield in response to the opposing forces applied to the first and second panel members 100, 200, respectively. Such yielding may allow the hook-shaped member 182 of the first panel member 100 to be locked in place within the box-shaped member 290 of the second panel member 200, thus providing engagement of the first panel member 100 with the second panel member 200. Successive panel members may be similarly engaged with the preceding panel members to provide a post-to-post panel assembly 650 (shown in FIG. 5).

Alternatively, the first matable means 180 may be slidably engageable with the second matable means 290. In such an embodiment, a first panel member 100 is provided having a first matable means 18 comprising a hook-shaped member 182. Then, a second panel member 200 is provided, having a second matable means comprising a box-shaped member 290. The first and second panel members 100 and 200 are then placed in end-to-end relation, being essentially coplanar with one another such that the inner surface 130 of the first panel member 100 opposes the inner surface 230 of the second panel member 200 and whereby the first matable means 180 is in essentially axial alignment with the second matable means 290. The leg portion 293 and arm portion 294 of the box-shaped member 290 of the second panel member 200 are inserted into the channel 185 of the hook-shaped member 182 of the first panel member 100. Then, the second panel member is slidably moved into side-by-side relation with the first panel member 100. It will be understood that the arm portion 814 of the hook-shaped member 182 of the first panel member 100 may also be inserted between the arm portion 294 and the first body portion 291 of the box-shaped member 290 of the second panel member 200, whereby the first panel member 100 would then be slidably moved into side-by-side relation with the second panel member 200.

The dimensions of the box-shaped member 290 and the hook-shaped member 182 are selected such that when the box-shaped member 290 is engaged by the hook-shaped member 182, the first panel member 100 is loosely connected to the second panel member 200, allowing lateral movement of the first panel member 100 relative the second panel member 200, and generally preventing substantial transverse and rotatable movement of the first panel member 100 relative the second panel member 200. In the preferred embodiment, the loose engagement is provided by a gap 98 between the leg portion 293 of the box-shaped member 290 and the body portion 183 of the hook-shaped member 182. When opposing forces are applied to the first panel member 100 and the second panel member 200, a portion of the leg portion 293 of the box-shaped member 290 contacts a portion of the body portion 183 of the hook-shaped member 182, thereby closing the gap 98.

Referring now to FIG. 4, a panel assembly 600 is shown in its expanded position, whereby the gap 98 (shown in FIG. 3) between the leg portion 293 of the box-shaped member 290 and the body portion 183 of the hook-shaped member 182 is closed. A gap 99 may thereby be formed between the arm portion 294 of the box-shaped member 290 and the arm portion 184 of the hook-shaped member 182. The loose connection between the first panel member 100 and the second panel member 200 allows for lateral adjustment, or expansion, of the panel assembly 600. When successive panel members (not shown) are connected to the panel assembly 600 in a similar manner, the entire structure is expandable. The gap, such as the gap 98 shown in FIG. 3, provided where each panel member is joined to its neighboring panel member, provides a unit expansion distance. Where a number of panel members are connected, the total expansion, or adjustment, distance of the resulting structure equals the sum of each unit expansion, or adjustment, distance.

Figures 5, 6, 7:
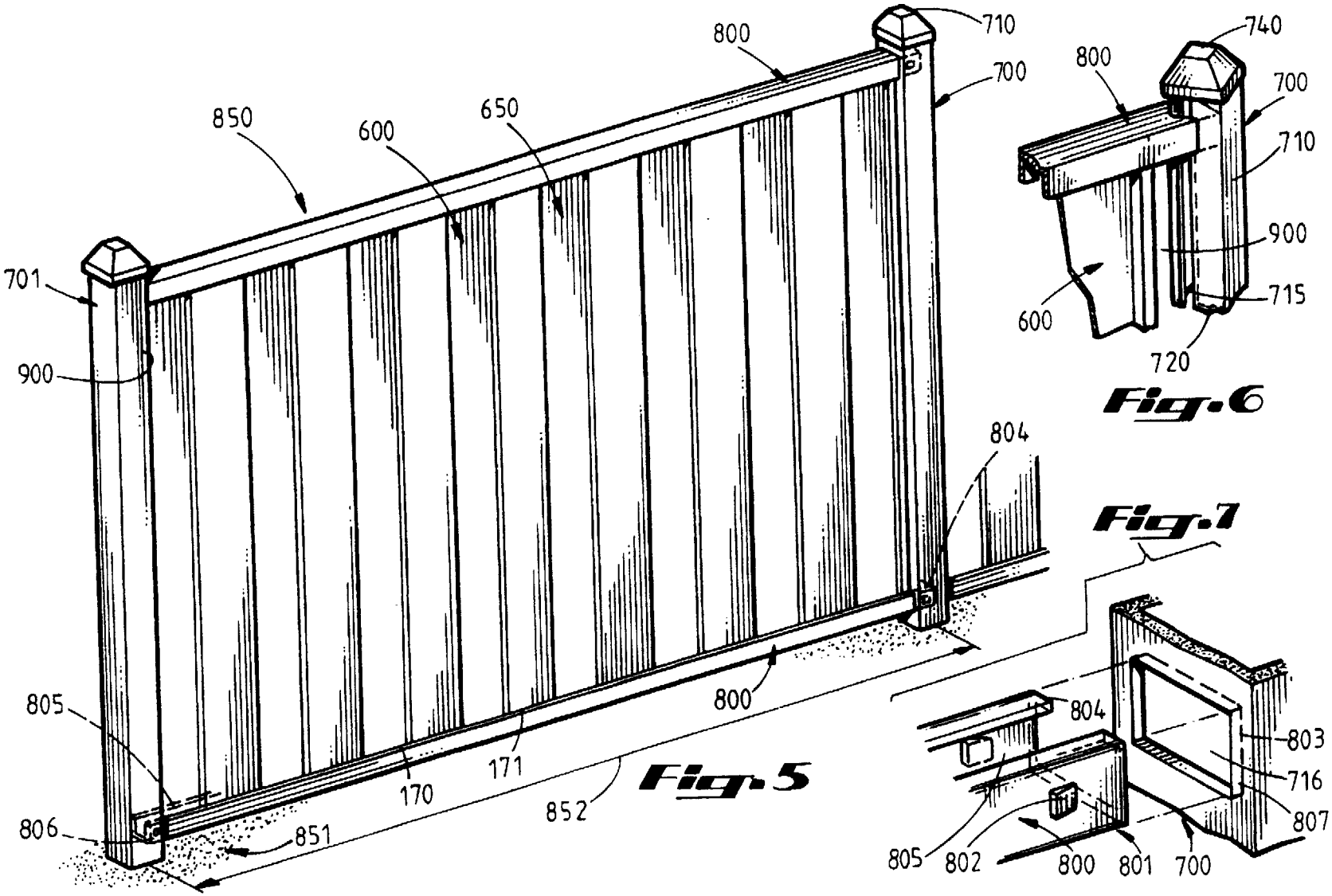
FIG. 5 is a perspective view of a portion of a fence and two fence posts, utilizing the adjustable-width panel assembly of the present invention, showing a closeable gap between a group of panel assemblies and a fence post.
FIG. 6 is a perspective view of an alternate embodiment of the present invention showing a fence post rotated approximately 45 degrees, and showing a slot for slidably attaching the panel assembly to the post without a separate fastener.
FIG. 7 is a perspective view of a portion of a stringer and a portion of a fence post, in accordance with the present invention, showing a stringer connecting means for connecting the stringer to the fence post.

Referring now to FIG. 5, the construction of a fence 850 utilizing a plurality of panel members 100 will be hereinafter described. First, at least one first fence post 700 is provided, which may be disposed proximate a foundation 851, which may be earthen or comprised of concrete or some other composition known in the art to be suitable for the support of a fence. In a preferred embodiment, a post hole is dug or otherwise created in the foundation material and a portion of the fence post 700 is deposited within the post hole. However, it should be understood that the fence may be free standing by utilizing any number of support means well known in the art. Then, at least one second fence post 701 is provided, spaced-apart from the first fence post 700, which may be of similar construction to the first fence post 700, and similarly disposed proximate foundation 851. A stringer 800 is provided, having a length sufficient to span a post distance 852 between first fence post 700 and the second fence post 701, and having sufficient length to be connected to the fence posts 700, 701.

Referring now to FIG. 7, a preferred embodiment of a stringer connecting means 801 is shown. Fence post 700, 701 may include an aperture 716 adapted to receive an end 804 of stringer 800. The stringer connecting means 801 may include a snapable projection 802, and an inner post surface 803 proximate an edge 807 provided at the periphery of aperture 716 of the fence post 700, 701. An end 804 of stringer 800 is inserted into fence post aperture 716 and a force is applied to the stringer 800 to force the stringer into the fence post 700, 701 to snapedly engage the projection 802 with the edge 807 of a first fence post 700. The second end 806 (shown in FIG. 5) of the stringer 800 is similarly engaged with a second fence post 701. In a preferred embodiment, the material composition of the stringer 800 may be selected to provide flexibility to bend the stringer 800 a sufficient amount to insert the second end 806 of stringer 800 into an aperture 716 similarly provided in the second fence post 701. A force is similarly applied to snap the projection 802 of the second end 806 of stringer 800 into engagement with the inner post surface 803 provided at the periphery of aperture 716 of the second fence post 701. It should be noted that the snapable projection 802 may not provide a fixed distance between posts. Rather, the snapable projection 802 may simply prevent the stringer 800 from slipping out of engagement with the fence posts 700, 701. Moreover, the stringer 800 may be of any length sufficient to provide support along a substantial portion of both the collapsed width and the expanded width of the post-to-post assembly 650.

Referring now to FIGS. 5 and 7, a slot 805 may be provided along the entire post distance, or post length 852 of stringer 800. A post-to-post assembly 650 is provided in accordance with the present invention, which may be comprised of a plurality of panel assemblies 600. The bottom edges 170, 270 of the plurality of panel members 100, 200 of the plurality of panel assemblies 600 defines a bottom edge 171 of the post-to-post assembly 650. The bottom edge 171 of the post-to-post assembly 650 is then deposited in slidable engagement within slot 805. A connecting portion 110, 210, 111, 211 of the post-to-post panel assembly 650 is attached to one of the fence posts 700, 701, such as fence post 701. In the event that the post distance 852 is slightly greater than the collapsed width of the post-to-post assembly 650, the post-to-post assembly 650 is laterally expanded so that the not yet attached connecting portion 110, 210, 111, 211 of the post-to-post panel assembly 650 abuts the inner face 720 of the other fence post 700. The not-yet attached connecting portion 110, 210, 111, 211 of the post-to-post panel assembly 650 is then attached to the fence post 700. A second stringer 800 is similarly provided proximate the top edge 160 of the post-to-post assembly 650, whereby the top edge 160 of the post-to-post assembly 650 is deposited into slidable engagement within slot 805 provided in the second stringer 800. The ends 804, 806 of the second stringer 800 are similarly engaged by stringer connecting means 801.

Preferably, the connecting portions 110, 210, 111,211 of the post-to-post panel assembly 650 are attached to the fence posts by way of conventional fasteners, such as pop-rivets. However, other means of attaching the connecting portions 110, 210, 111, 211 to fence posts 700, 701 may be provided, as is hereinafter described. By way of example, referring now to FIG. 6, a slot 715 may be provided along the length of fence post 700, 701, whereby a final panel member 100, 200 may be slidably engaged by both a preceding panel member 100, 200 and the slot 715 provided in fence post 700, 701. A cap 740 may then be provided atop fence post 700, 701 for cosmetic purposes and/or to provide further structural integrity. Such an alternate means for attaching the connecting the post-to-post panel assembly 650 to the fence posts 700, 701 may provide means for attachment when the fence posts 700, 701 are rotated 45 degrees, which rotation may lessen the flush engagement of the connecting portions 110, 210, 111, 211 provided proximate the inner face 720 of the fence post 700, 701.

The operation of an embodiment of the present invention may be better understood by way of the following description, which is to be understood as being presented for illustrative purposes only. For example, using a panel assembly consisting of 19 panel members, the width of each panel member being 5.825 inches, constructed so that that gap is 0.120 inches, the collapsed width of the entire panel assembly equals 91.037 inches and the expanded width of the panel assembly equals 93.097, thus providing a total expansion, or lateral adjustment, distance of 2.060 inches. Such expansion or lateral adjustment, distance may allow for installation of a fence using the panel assembly of the present invention without cutting of the panel members or the use of separate fasteners in a situation where the fence posts aren't equally spaced on precise 8' centers.

By utilizing an adjustable-width panel assembly, one may provide significant flexibility in the location of the supporting members to which the panel assembly may be connected. It should be noted that the dimensions heretofore used are illustrative only and the exact dimensions used in a particular embodiment of an adjustable-width panel assembly may vary according to the size of the panel member desired, the materials used, and other factors.

It is to be understood that the invention is not limited to the exact details of construction, operation, exact materials, or embodiments shown and described, as obvious modifications and equivalents will be apparent to one skilled in the art; for example, the body of the panel members may be configured having alternating, opposing U-shaped or V-shaped portions, or may be provided with other channels or ribs for strength or appearance. Also, successive panel members may be inter-connected to span a distance such as a horizontal distance between fence posts or a vertical distance between fence stringers. Also, the top and/or bottom portions may include means for connecting the panel member to a supporting structure such as a stringer where the panel member is installed vertically, or a post where the panel member is installed horizontally. Also, the laterally adjustable means for connecting the panel members may be used in combination with separate fasteners once the panel assembly is in place to provide additional support. Also, the panels may be used in the construction of other structures such as roofs. Also, any number of panel members may be adjustable, with some panel members being non-adjustable. Further, any suitable materials may be used and the surfaces of the present invention may include patterns such as to simulate, for example, woodgrain. Accordingly, the invention is therefore to be limited only by the scope of the appended claims.

What is claimed:

1. An adjustable-width panel assembly having a width, the panel assembly comprising:

(a) at least one first panel member, having a desired length, a connecting portion, first and second side portions, top and bottom edges, and inner and outer surfaces;

(b) at least one second panel member, having a desired length, a connecting portion, first and second side portions, top and bottom edges, and inner and outer surfaces; and (c) laterally adjustable connection means for connecting the connecting portion of the first panel member to the connecting portion of the second panel member, the laterally adjustable connection means including:

(1) a first matable means proximate the connecting portion of the first panel member, the first matable means including a generally hook-shaped member disposed at least partially along the length of the first panel member, the generally hook-shaped member including: (a) a body portion with a length, the body portion extending from the inner surface of the first panel member generally transverse to the first panel member; (b) an arm portion extending generally angularly from the body portion generally in the direction away from the first side portion of the first panel member and generally in the direction of the inner surface of the first panel member; and (c) a channel disposed between the body portion and the arm portions of the hook-shaped member; and (2) a second matable means proximate the connecting portion of the second panel member, the second matable means including a generally box-shaped member disposed at least partially along the length of the second panel member, the generally box-shaped member having: (a) a first body portion extending from the inner surface of the second panel member generally transverse to the second panel member; (b) a second body portion disposed proximate the first body portion of the box-shaped member and extending generally in the direction away from the second side portion of the first panel member; (c) a leg portion disposed proximate the second body portion of the box-shaped member, extending generally in the direction of the inner surface of the second panel member, being adapted to be insertable into the channel of the hook-shaped member of the first panel member, and having a length less than the length of the body portion of the hook-shaped member of the first matable means; and (d) an arm portion disposed proximate the leg portion, extending generally angularly in the general direction of the first body portion of the box-shaped member, and being adapted to be insertable into the channel of the hook-shaped member of the first panel member, whereby at least a portion of the box-shaped member of the second matable means is loosely engageable with at least a portion of the hook-shaped member of the first matable means to loosely interconnect the first and second panel members such that each of the inter-connected panel members is laterally moveable relative one another.

* * * * *